US010064532B2

(12) United States Patent
Betton et al.

(10) Patent No.: US 10,064,532 B2
(45) **Date of Patent: *Sep. 4, 2018**

(54) CLEANING SYSTEM UTILIZING A REGENERATIVE BLOWER

(71) Applicant: Nilfisk A/S, Brøndby (DK)

(72) Inventors: Horace Kurt Betton, Ocoee, FL (US); Mark Wayne Baxter, Coeur d' Alene, ID (US); Lance Ronal Joseph Koty, Marysville, WA (US); Christopher Isamu Ryan, Lynnwood, WA (US)

(73) Assignee: NILFISK A/S, Brondby (DK)

( * ) Notice: Subject to any disclaimer, the term of this patent is extended or adjusted under 35 U.S.C. 154(b) by 0 days.

This patent is subject to a terminal disclaimer.

(21) Appl. No.: 15/162,137

(22) Filed: May 23, 2016

(65) Prior Publication Data

US 2016/0262588 A1 Sep. 15, 2016

Related U.S. Application Data

(63) Continuation of application No. 14/203,169, filed on Mar. 10, 2014, now Pat. No. 9,345,373.

(60) Provisional application No. 61/792,754, filed on Mar. 15, 2013.

(51) Int. Cl.

| | |
|---|---|
| ***A47L 11/34*** | (2006.01) |
| ***A47L 11/40*** | (2006.01) |
| ***F04D 17/16*** | (2006.01) |
| ***F04D 23/00*** | (2006.01) |

(52) U.S. Cl.

CPC ..... *A47L 11/34* (2013.01); *A47L 11/4005* (2013.01); *A47L 11/4016* (2013.01); *A47L 11/4083* (2013.01); *A47L 11/4088* (2013.01); *A47L 11/4097* (2013.01); *F04D 17/168* (2013.01); *F04D 23/008* (2013.01); *F05B 2250/503* (2013.01)

(58) Field of Classification Search

CPC ..... A47L 11/4005; A47L 11/4083; F04D 17/168; F04D 23/008; F05B 2250/503

See application file for complete search history.

(56) References Cited

U.S. PATENT DOCUMENTS

| | | | | |
|---|---|---|---|---|
| 4,949,424 | A * | 8/1990 | Shero | A47L 11/34 15/321 |
| 5,371,918 | A | 12/1994 | Shero | |
| 5,815,869 | A | 10/1998 | Hopkins | |
| 5,950,273 | A * | 9/1999 | Suhaka | A47L 9/0081 15/321 |
| 5,979,012 | A | 11/1999 | Fritz | |
| 6,675,437 | B1 * | 1/2004 | York | A47L 11/34 15/320 |
| 7,191,489 | B1 * | 3/2007 | Heath | B08B 3/026 15/320 |
| 7,600,289 | B2 | 10/2009 | Hayes et al. | |
| 9,345,373 | B2 * | 5/2016 | Betton | A47L 11/34 |

(Continued)

*Primary Examiner* — Dung Van Nguyen

(74) *Attorney, Agent, or Firm* — Schwegman Lundberg & Woessner, P.A.

(57) ABSTRACT

A cleaning system comprises a power plant, a regenerative blower having a power input shaft, a suction port, and a discharge port, an interface assembly configured for transmitting power from the power plant to the regenerative blower, a pump configured for generating pressurized water, and a heat exchanger system configured for heating the pressurized water.

18 Claims, 12 Drawing Sheets

(56) References Cited

U.S. PATENT DOCUMENTS

| | | | |
|---|---|---|---|
| 2010/0200080 | A1 | 8/2010 | Roden |
| 2014/0259512 | A1 | 9/2014 | Betton et al. |

* cited by examiner

CLEANING SYSTEM UTILIZING A REGENERATIVE BLOWER

PRIORITY APPLICATIONS

This application is a continuation of U.S. patent application Ser. No. 14/203,169, filed on Mar. 10, 2014, and issued as U.S. Pat. No. 9,345,373 on May 24, 2016, which claims the benefit of priority to U.S. Provisional Application Ser. No. 61/792,754, filed Mar. 15, 2013, the benefit of priority of each of which is claimed hereby, and each of which is incorporated by reference herein in its entirety.

BACKGROUND

The present patent application relates to surface cleaning systems, and, more particularly, to a surface cleaning system that utilizes a regenerative blower as a vacuum source.

Cleaning carpet, upholstery, tile floors, and other surfaces enhances the appearance and extends the life of such surfaces by removing the soil embedded in the surface. Moreover, carpet cleaning removes allergens, such as mold, mildew, pollen, pet dander, dust mites, and bacteria. Indeed, regular cleaning keeps allergen levels low and thus contributes to an effective allergy avoidance program.

Vacuum extractors for cleaning surfaces, such as carpet, typically deposit a cleaning fluid upon the carpet or other surface to be cleaned. The deposited fluid, along with soil entrained in the fluid, is subsequently removed by high vacuum suction. This enables the carpet to be completely dry before mold has time to grow. The soiled fluid, i.e., waste fluid, is then separated from the working air and is collected in a recovery tank.

Due to the prevalence of carpeted surfaces in commercial establishments, institutions, and residences, there exists a thriving commercial carpet cleaning industry. In order to maximize the efficacy of the cleaning process, industrial floor cleaning systems should be powerful to minimize the time in which the soil entrained cleaning fluid is present in the carpet. Industrial floor cleaning systems should also be durable. That is, such a cleaning system should be manufactured from durable working parts so that the system has a long working life and requires little maintenance.

Industrial floor cleaning systems generally provide for the management of heat, vacuum, pressure, fresh and gray water, chemicals, and power to achieve the goal of efficient, thorough cleaning of different surfaces, usually carpets but also hard flooring, linoleum and other surfaces, in both residential and commercial establishments. Professional surface cleaning systems are also utilized in the restoration industry for water extraction.

Of the many industrial surface cleaning systems available, a major segment are self-contained having an own power plant, heat source, vacuum source, chemical delivery system, and water dispersion and extraction capabilities. These are commonly referred to as "slide-in" systems and install permanently in cargo vans, trailers, and other commercial vehicles, but can also be mounted on portable, wheeled carts. Slide-in systems comprise a series of components designed and integrated into a package with an overall goal of performance, economy, reliability, safety, useful life, serviceability, and sized to fit in various commercial vehicles.

Currently, the vacuum source found in the industrial surface cleaning systems comprises a positive displacement blower. One common type of positive displacement blower is a rotary blower. Rotary blowers typically include two or more meshing lobes that rotate within a blower chamber. In operation, as the lobes rotate, air is trapped in pockets surrounding the lobes and is carried from an intake side of the blower to an exhaust side of the blower. Positive displacement blowers are designed such that there is no contact between the lobes and the walls of the blower chamber, and the air is trapped due to the substantially low clearance between the components. However, because of the clearance that must be maintained between the lobes and the chamber walls, single-stage blowers can pump air across only a limited pressure differential. Furthermore, if the blower is used outside of its specified operating conditions, the compression of the air can generate such a large amount of heat that the lobes may expand to the point that they become jammed within the blower chamber, thereby damaging the pump. Because of the limited pressure differential that can be generated by a single-stage blower and the potential for damaging the blower if blower is run too hot, some industrial surface cleaning systems use blowers having multiple stages, which adds to the cost of the blower.

Positive displacement pumps, while popular, have several downfalls associated with their use. As discussed above, because rotary blowers are sensitive to heat, there is a risk of damaging the blower if the operation of the blower is not carefully monitored. Damage to the blower can include, for example, timing issues, clashing of the lobes, and total blower failure due to jamming of the components within the blower housing. Over time, reliability can also be an issue if proper maintenance is not performed. Rotary blowers also produce a significant amount of vibration during operation, which can lead to increased wear and tear on the blower and adjacent components of the cleaning system. Furthermore, rotary blowers can be very noisy. The noise produced by rotary blowers is not only a nuisance to those in the vicinity of the cleaning system, but it can also contribute to hearing loss if proper ear protection is not worn.

OVERVIEW

To better illustrate the cleaning system disclosed herein, a non-limiting list of examples is provided here:

In Example 1, a cleaning system can be provided that includes a power plant, a regenerative blower having a power input shaft, a suction port, and a discharge port, an interface assembly configured for transmitting power from the power plant to the regenerative blower, a pump configured for generating pressurized water, and a heat exchanger system configured for heating the pressurized water.

In Example 2, the cleaning system of Example 1 is optionally configured to include a support frame, wherein at least one of the power plant, the regenerative blower, and the pump is coupled to the support frame.

In Example 3, the cleaning system of any one of or any combination of Examples 1-2 is optionally configured to include one or more wands having an input configured to receive the pressurized water for distribution to a surface to be cleaned.

In Example 4, the cleaning system of Example 3 is optionally configured to include one or more delivery hoses extending between the pump and the one or more wands and configured to deliver the pressurized water to the one or more wands.

In Example 5, the cleaning system of Example 4 is optionally configured to include a vacuum recovery tank, the vacuum recovery tank having a first input coupled to the suction port of the regenerative blower and one or more second inputs coupled to one or more vacuum hoses extending between the recovery tank and the one or more wands.

In Example 6, the cleaning system of Example 5 is optionally configured to include a chemical distribution system configured to deliver a stream of cleaning chemical into the pressurized water for delivery by the one or more wands.

In Example 7, the cleaning system of Example 6 is optionally configured such that the discharge port of the regenerative blower is operably coupled to the heat exchanger system and configured to provide exhaust gases for heating the pressurized water.

In Example 8, the cleaning system of any one of or any combination of Examples 1-7 is optionally configured such that the regenerative blower includes an impeller coupled to the power input shaft.

In Example 9, the cleaning system of Example 8 is optionally configured such that the impeller is formed integral with the power input shaft.

In Example 10, the cleaning system of any one of or any combination of Examples 1-9 is optionally configured such that the power plant is a combustion engine.

In Example 11, the cleaning system of any one of or any combination of Examples 1-9 is optionally configured such that the power plant is an electric motor.

In Example 12, a cleaning system can be provided that includes a power plant having a power output shaft, a regenerative blower including a blower housing having a suction port and a discharge port and defining a blower chamber, the regenerative blower further including an impeller disposed within the blower chamber and a power input shaft extending from the impeller, an interface assembly configured for transmitting power from the power output shaft of the power plant to the power input shaft of the regenerative blower, a pump configured for generating pressurized water, a heat exchanger system configured for heating the pressurized water, and one or more wands having an input configured to receive the pressurized water for distribution to a surface to be cleaned.

In Example 13, the cleaning system of Example 12 is optionally configured to include a vacuum recovery tank, the vacuum recovery tank having a first input coupled to the suction port of the regenerative blower and one or more second inputs coupled to one or more vacuum hoses extending between the recovery tank and the one or more wands.

In Example 14, the cleaning system of any one of or any combination of Examples 12-13 is optionally configured such that the blower housing includes a first housing portion and a second housing portion configured to be secured together to substantially enclose the impeller.

In Example 15, the cleaning system of Example 14 is optionally configured to include a bearing assembly positioned between an inner surface of one of the first housing portion and the second housing portion and a central hub of the impeller, the bearing assembly configured to allow rotation of the impeller relative to the blower housing.

In Example 16, the cleaning system of any one of or any combination of Examples 12-15 is optionally configured such that the impeller includes a central hub and a plurality of blades extending around a circumference of the central hub, wherein each of the blades is curved between a first end adjacent to the central hub and a second end spaced from the central hub.

In Example 17, the cleaning system of any one of or any combination of Examples 12-16 is optionally configured such that the discharge port includes a silencer configured to reduce a noise output level of the regenerative blower.

In Example 18, the cleaning system of any one of or any combination of Examples 12-17 is optionally configured such that the power plant is a combustion engine.

In Example 19, the cleaning system of any one of or any combination of Examples 12-17 is optionally configured such that the power plant is an electric motor.

In Example 20, a vacuum extraction cleaning system can be provided that includes a power plant and a regenerative blower including a blower housing having a suction port and a discharge port and defining a blower chamber, one or more impellers disposed within the blower chamber, a power input shaft extending from the one or more impellers, and one or more bearings configured to allow rotation of the one or more impellers within the blower chamber. The vacuum extraction apparatus can further include an interface configured to allow coupling of the power plant to the power input shaft of the regenerative blower, a pump configured for generating pressurized water, a heat exchanger system configured for heating the pressurized water, one or more wands configured to receive the pressurized water for distribution to a surface to be cleaned, and a vacuum recovery tank, the vacuum recovery tank having a first input coupled to the suction port of the regenerative blower and one or more second inputs coupled to one or more vacuum hoses extending between the recovery tank and the one or more wands.

In Example 21, the cleaning system of any one of or any combination of Examples 1-20 is optionally configured such that all elements or options recited are available to use or select from.

This overview is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

The present patent application relates to a regenerative blower for a cleaning system, such as a truck-mounted cleaning system, that utilizes vacuum extraction to remove gray water from a floor surface. Truck-mounted cleaning systems generally fall into two categories, including slide-in systems and vehicle-powered systems. Slide-in systems can be powered by their own engines, or power plants, and can be supported by a frame that is secured to the vehicle. Vehicle-powered systems differ from slide-in systems in that they receive power from the engine, or power plant, of the vehicle rather than from a dedicated engine of the cleaning system. However, both slide-in systems and vehicle-powered systems can include components for supplying cleaning solution, heat, pressure, and vacuum for the cleaning operation.

One benefit of slide-in systems over vehicle-powered systems is that they can be transferred between vehicles with relative ease. However, as compared to vehicle-powered systems, slide-in systems generally require more cargo space in a vehicle.

For purposes of example only, the cleaning system of the present disclosure is described as a slide-in cleaning system. However, various components of the cleaning system, such as the drive system, can be modified to provide for a vehicle-powered system rather than a slide-in system. Thus, both slide-in systems and vehicle-powered systems are within the intended scope of the present disclosure.

Figure 1:
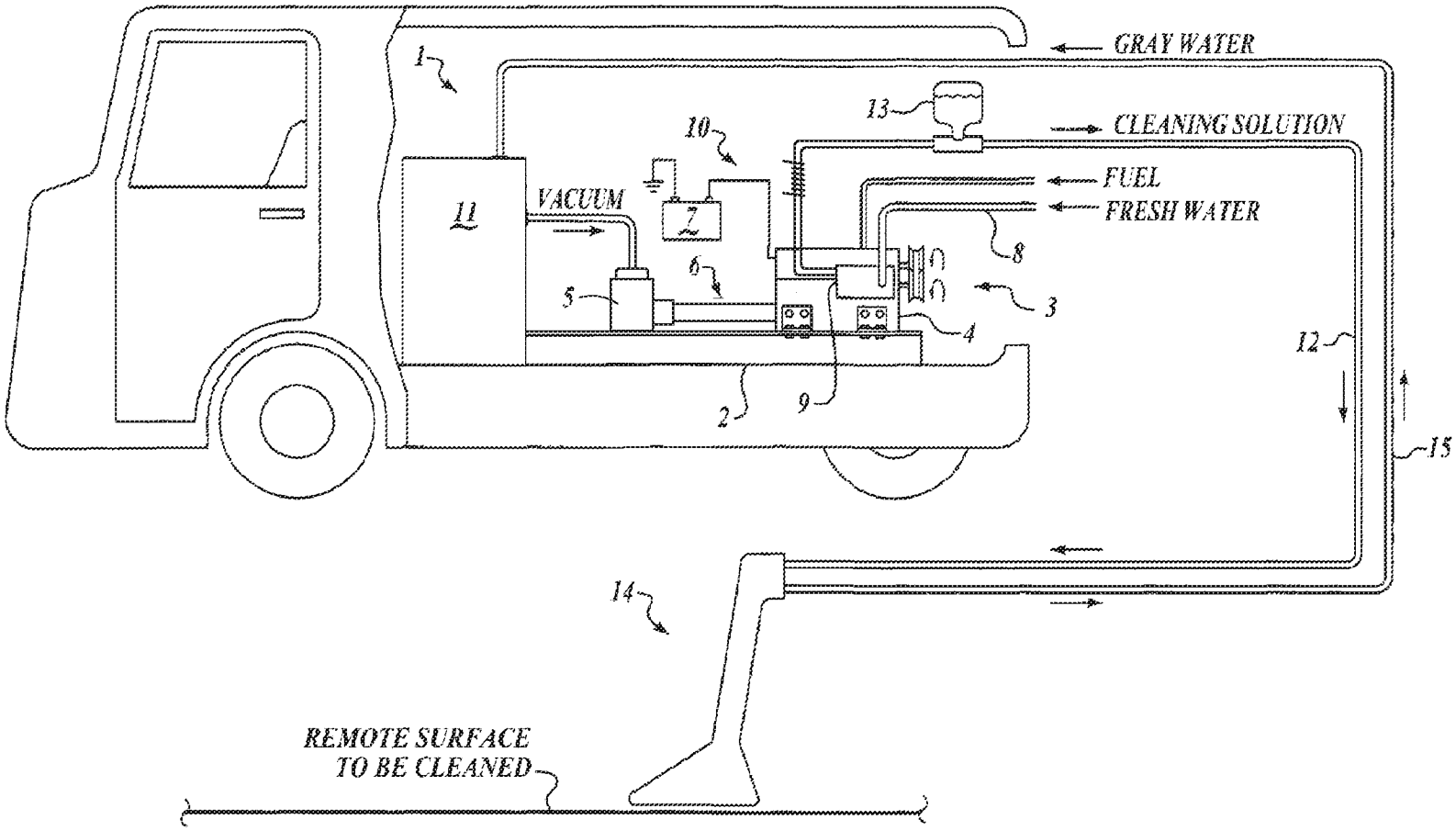
FIG. 1 is a diagrammatic illustration of an industrial slide-in cleaning system, in accordance with at least one example of the present disclosure.

FIG. 1 is a diagrammatic illustration of a slide-in cleaning system 1 configured cleaning carpets, hard flooring, linoleum, and other surfaces in accordance with at least one example of the present disclosure. As illustrated in FIG. 1, the cleaning system 1 can include a structural platform or support frame 2 onto which various components can be mounted. In an example, the cleaning system 1 can include a drive system 3 mounted on the support frame 2 and having a power plant 4 coupled to receive fuel from an appropriate supply, a regenerative blower 5 that can operate as the vacuum source for removing soiled liquid from the cleaned surface, and an interface assembly 6 for transmitting power from the power plant 4 to the regenerative blower 5. The power plant 4 can be, for example, any steam or internal combustion motor, such as a gasoline, diesel, alcohol, propane, or other fueled internal combustion engine. Alternatively, the power plant 4 can be an electric motor driven by a battery or other source of electric power, or a hybrid motor that operates on both electric power and a fuel power source. As discussed above, in a vehicle-driven system, the power plant can be the engine of the vehicle in which the cleaning system is mounted. With further reference to FIG. 1, a battery 7 can be provided as a source of electric energy for starting the power plant 4. An intake hose 8 can be coupled to a source of fresh water, and a water pump 9 can be driven by the power plant 4 via any suitable means, such as a V-belt or a direct drive, for pressurizing the fresh water.

As illustrated in FIG. 1, one or more heat exchanger systems 10 can be coupled for receiving and heating the pressurized fresh water. A recovery tank 11 can be provided for storing gray water after removal from the cleaned surface. A high pressure solution hose 12 can be provided for delivering pressurized, hot water or a hot water and chemical solution from the cleaning system 1 to a surface to be cleaned. In an example, a chemical container 13 or other chemical system can be coupled for delivering a stream of cleaning chemical into the hot water as it enters the high-pressure solution hose 12. At least one wand 14 can be coupled to the high pressure solution hose 12 for receiving and dispersing the pressurized hot water or hot water and chemical cleaning solution to the surface to be cleaned. In various examples, two or more wands 14 can be provided, wherein each wand 14 is coupled to a dedicated high pressure solution hose 12. The wand 14 can be removed from the vehicle and carried to the carpet or other surface to be cleaned. Thus, in an example, the wand 14 can be the only "portable" part of cleaning system 1, with all other components of the cleaning system 1 remaining stationary within the vehicle during a cleaning operation. The delivery wand 14 can be coupled via a vacuum hose 15 to the recovery tank 11, which can in turn be coupled to the high vacuum provided by the regenerative blower 5, for recovering the used cleaning solution from the cleaned surface and delivering it to the recovery tank 11.

In an example, the power plant 4 and the regenerative blower 5 of the drive system 3 can be independently hard-mounted on the support frame 2 either directly using one or more mechanical fasteners 16, or indirectly using one or more mounting plates or brackets 17. In an alternative example, the power plant 4 and the regenerative blower 5 can be mounted together as a combined unit, which is then mounted either directly or indirectly on the support frame 2. Thus, independent mounting of the power plant 4 and the regenerative blower 5 is shown merely for purposes of example and not limitation. Any suitable mechanical fasteners 16 can be used including, but not limited to, bolts, screws, or the like. The brackets 17 can be formed from any suitable material, such as metal. The support frame 2 can be configured for mounting in a van, truck or other suitable vehicle for portability, as illustrated in FIG. 1. In an example, the support frame 2 can be wheeled for portability independent of the vehicle, and can optionally be sized and structured to incorporate the recovery tank 11.

The cleaning system 1 can operate by delivering fresh water to an inlet of the system utilizing, for example, a standard garden hose or a fresh-water container. The system can add energy to the fresh water, i.e., pressurize it, by means of the pump 9. The fresh water can be pushed throughout the one or more heat exchanger systems 10 using pressure provided by the pump 9. The one or more heat exchanger systems 10 can gain their heat by thermal energy rejected from the regenerative blower 5 or the power plant 4, e.g., from hot exhaust gasses, coolant water used on certain engines, or other suitable means. On demand from the wand 14, the pump 9 can drive the heated water through the solution hose 12 where one or more cleaning chemicals can be added from the chemical container 13, and then can deliver the water-based chemical cleaning solution to the wand 14 for cleaning the floor, carpet or other surface. The hot water can travel, for example, between about 50 feet and about 300 feet to the wand 14. The operator can deliver the hot solution via the wand 4 to the surface to be cleaned, and can almost immediately extract the solution along with soil that has been emulsified by thermal energy or dissolved and divided by chemical energy. The extracted, soiled water can be drawn via the vacuum hose 15 into the recovery tank 11 for eventual disposal as gray water. An auxiliary pump (not shown), commonly referred to as an APO or Automatic Pump Out device, may be driven by the power plant 4 for automatically pumping the gray water from the recovery tank 11 into a sanitary sewer or other approved dumping location. Alternatively, this task can be performed manually.

Various types of interface assemblies 6 can be used for transmitting power from the power plant 4 to the regenerative blower 5. A non-exhaustive subset of such interface assemblies is discussed below. However, it should be understood that regenerative blowers in accordance with the present disclosure can be utilized in cleaning systems that incorporate any type of interface assembly. Thus, the interface assemblies described herein are provided merely for purposes of example and not limitation. Furthermore, the type of interface assembly utilized can depend on the type of power plant selected for a particular cleaning system, such as an internal combustion engine or an electric motor.

One type of interface assembly that can be used for transmitting power from the power plant 4 to the regenerative blower 5 is a rigid, direct drive coupling, which is discussed in further detail below with reference to FIGS. 2 and 3. Another type of interface assembly can include a belt drive system, which can be configured to transmit power through a series of pulleys and belts coupled to the power plant 4 and regenerative blower 5. Another type of interface assembly can include a flexible coupling, such as a "Waldron" coupling. Waldron couplings can generally utilize two hubs that can be structured for positive mounting on respective power plant and blower shafts. External splines on the hubs can be engaged by internal splines cut on a bore of a casing or sleeve surrounding the hubs. The external and/or internal splines can be formed of an elastomer, such as neoprene or nylon, for absorbing vibrations and impacts due to fluctuations in shaft torque or angular speed. Alternative flexible couplings for transmitting power from the power plant 4 to the regenerative blower 5 can include chain couplings that use either silent chains or standard roller chains with mating sprockets, and steelflex couplings that use two grooved steel hubs keyed to the respective shafts, wherein connection between the two hubs can be accomplished with a specially tempered alloy-steel member called a "grid." Another type of interface assembly can include a universal joint, such as a Bendix-Weiss "rolling-ball" universal joint. Rolling ball universal joints can provide constant angular velocity with torque being transmitted between two yokes through a set of balls such that the centers of all of the balls lie in a plane which bisects the angle between the shafts of the power plant 4 and the regenerative blower 5. Another type of interface assembly can include a fluid coupling, wherein power is transmitted by kinetic energy in the operating fluid rather than through a mechanical connection between the shafts of the power plant 4 and the regenerative blower 5. Yet another type of interface assembly can include a clutch, which can permit disengagement of the coupled shafts of the power plant 4 and the regenerative blower 5 during rotation. Positive clutches, such as jaw and spiral clutches, can be configured to transmit torque without slip. Friction clutches can be configured to reduce coupling shock by slipping during engagement, and can also serve as safety devices by slipping when the torque exceeds their maximum rating.

Figure 2:
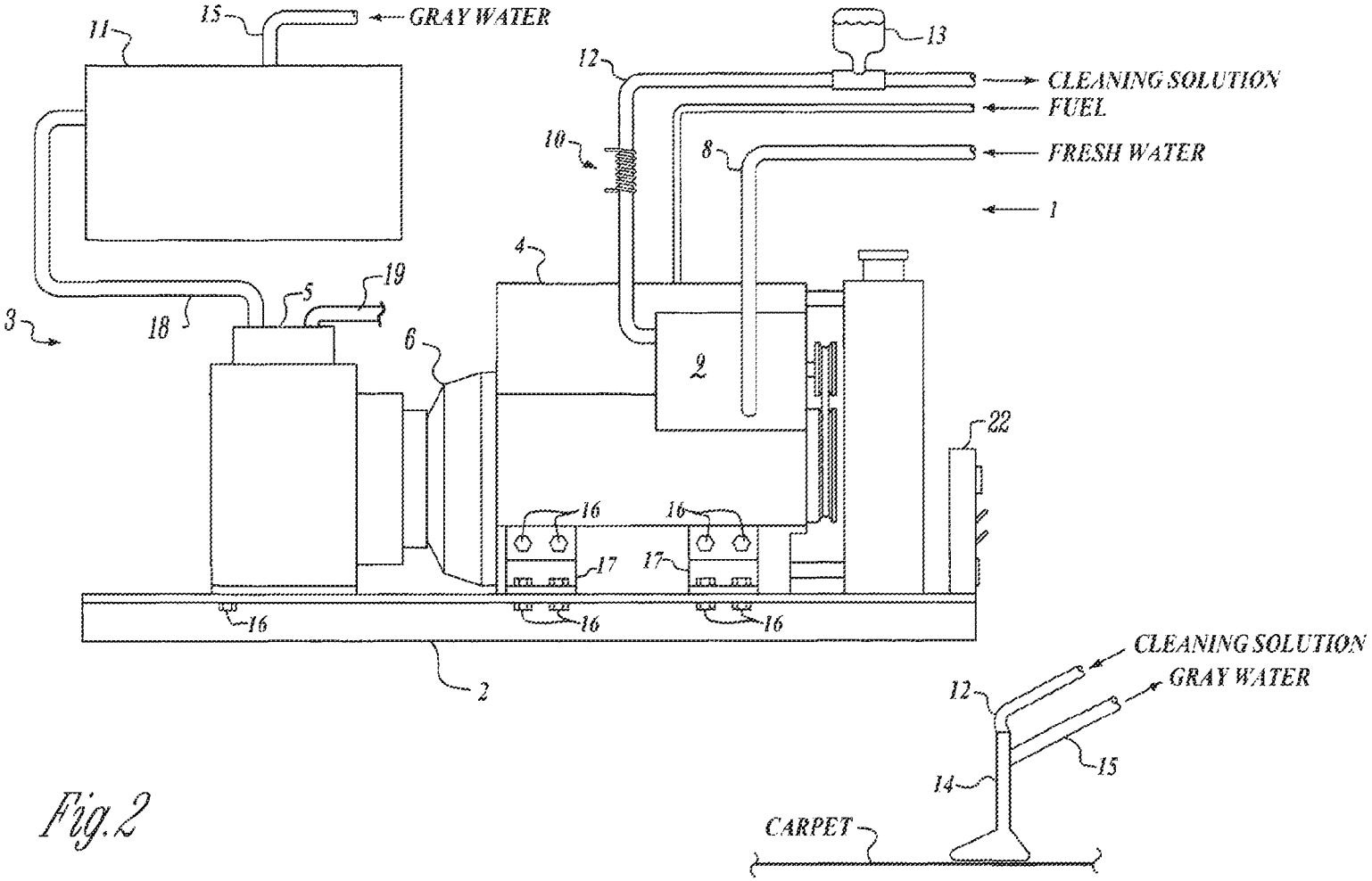
FIG. 2 is a further diagrammatic illustration of the cleaning system of FIG. 1, in accordance with at least one example of the present disclosure.

FIG. 2 is a further diagrammatic illustration of the cleaning system 1 of FIG. 1. The cleaning system 1 is illustrated with a rigid, direct drive interface assembly 6 merely for purposes of example and illustration. Thus, any suitable interface assembly, including but not limited to those describe above, can be used to transmit power between the power plant 4 and the regenerative blower 5. As discussed above with reference to FIG. 1, the drive system 3 can include the power plant 4, the regenerative blower 5, and the interface assembly 6. As further illustrated in FIG. 2, the regenerative blower 5 can be coupled via vacuum piping 18 for generating high vacuum in the recovery tank 11, which can provide a suitable volume for carpet and other surface cleaning operations and can include baffles, filters, and/or other means for preventing gray or other water from entering the regenerative blower 5. Additionally, regenerative blowers themselves can be designed such that they are substantially impervious to water and debris ingestion. The recovery tank 11 can be mounted, for example, in the vehicle near the drive system 3, as illustrated in FIG. 1. An output of the regenerative blower 5 can be operably coupled, via exhaust piping 19, to the heat exchanger system 10 for delivering exhaust gases to heat the pressurized water.

In an example, as illustrated in FIG. 2, the power plant 4, the regenerative blower 5, and the interface assembly 6 of the drive system 3 can be joined together as an integral structural unit and mounted on the support frame 2. Particularly, in an example, the components of the drive system 3 can be co-mounted on the support frame 2 in metal-to-metal contact therewith. As illustrated in FIG. 2, the components can be mounted to the support frame 2 using one or more mechanical fasteners 16 and, optionally, one or more mounting plates or brackets 17. The support frame 2 can be, as discussed above, used for mounting the cleaning system 1 in a van, truck, or other suitable vehicle for portability. Thus, the support frame 2 can provide amounting surface for attaching the cleaning system 1 to the vehicle, shown in FIG. 1, and can also provide for vibration damping during operation of the cleaning system 1. As further illustrated in FIG. 2, the support frame 2 can include an operations panel 22 for mounting gages, switches, and controls useful in operation of the cleaning system 1, whereby an operator can read the gages, operate the switches, and operate thermal and fluid management systems.

Figure 3:
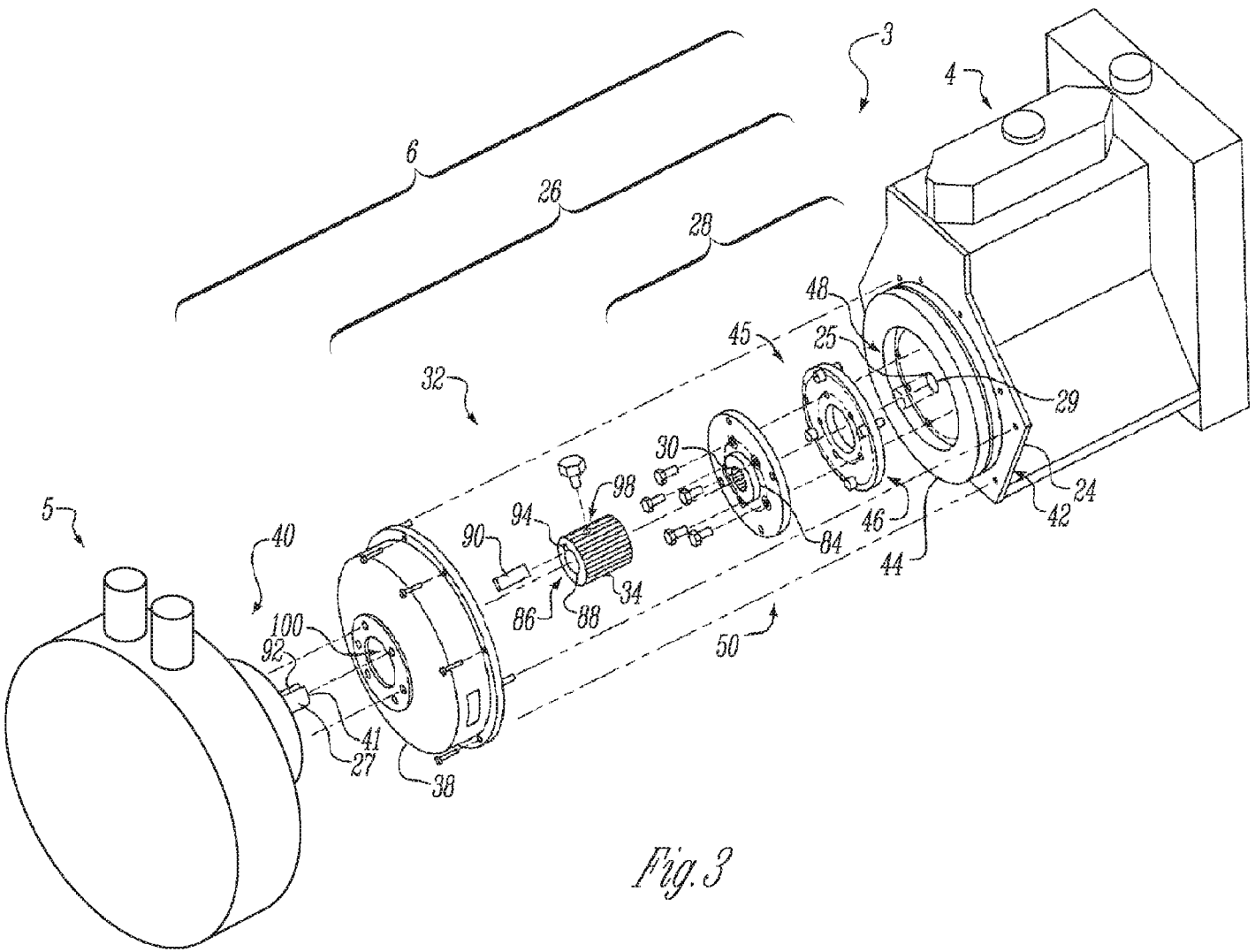
FIG. 3 is an exploded perspective view of a drive system, in accordance with at least one example of the present disclosure.
Figure 4A:
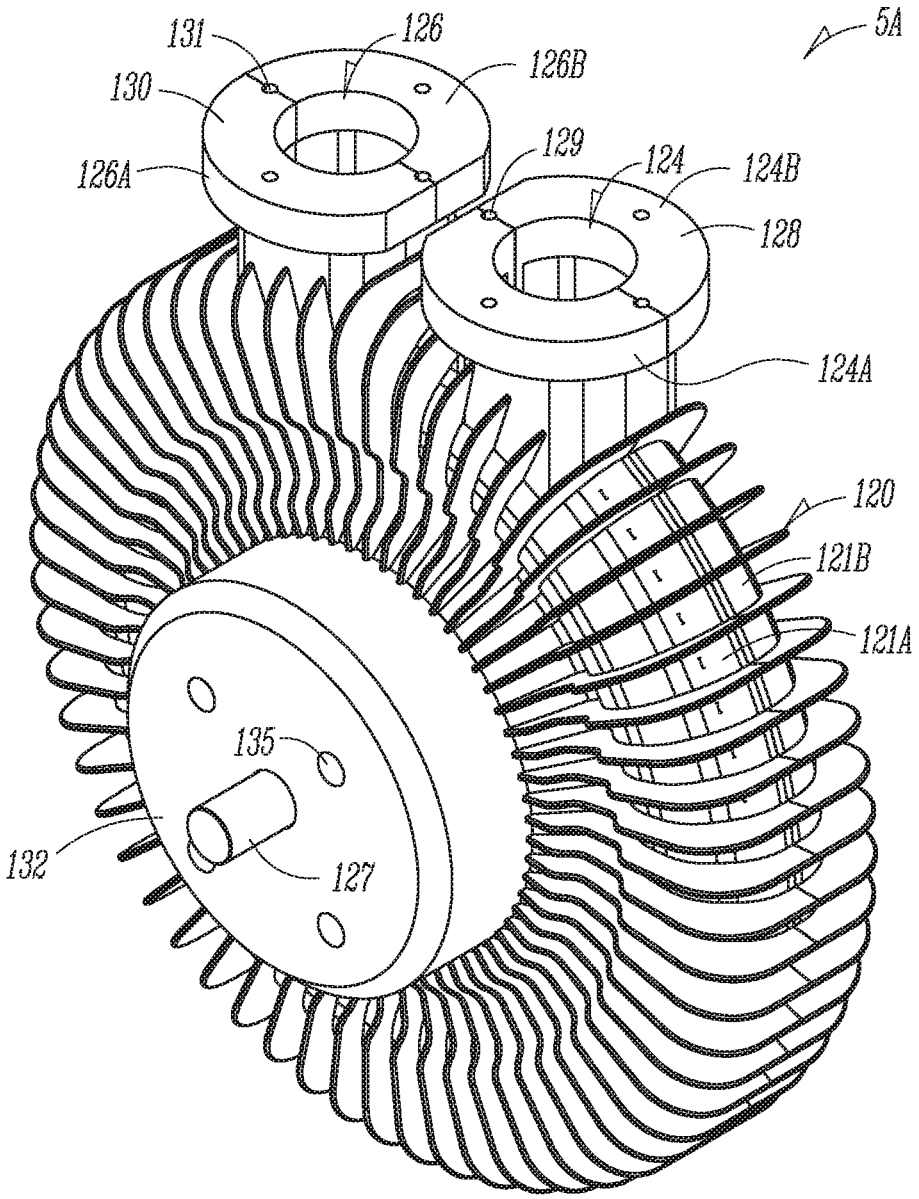
FIGS. 4A-E are perspective, front, rear, side, and top views, respectively, of a regenerative blower, in accordance with at least one example of the present disclosure.
Figure 4B:
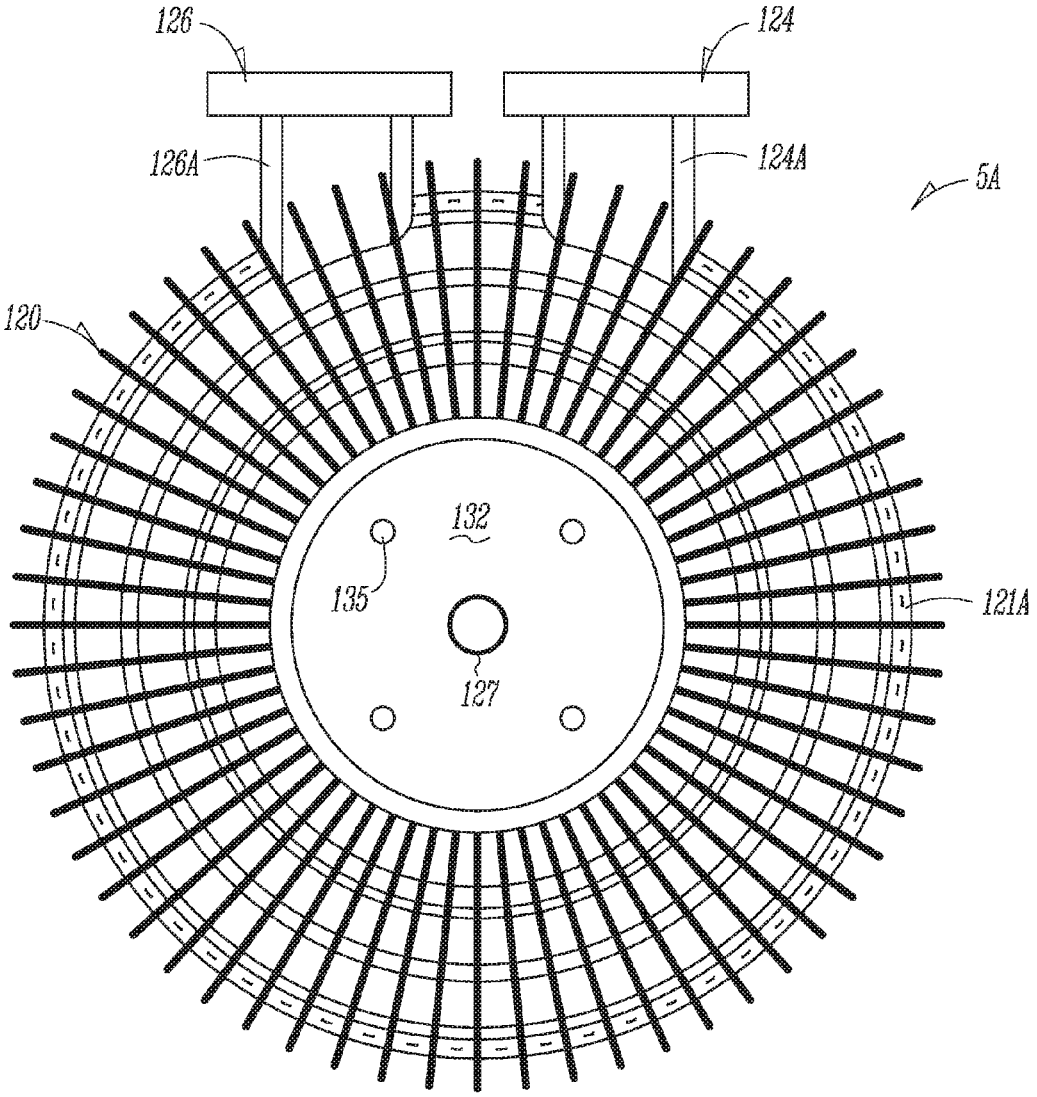
Figure 4C:
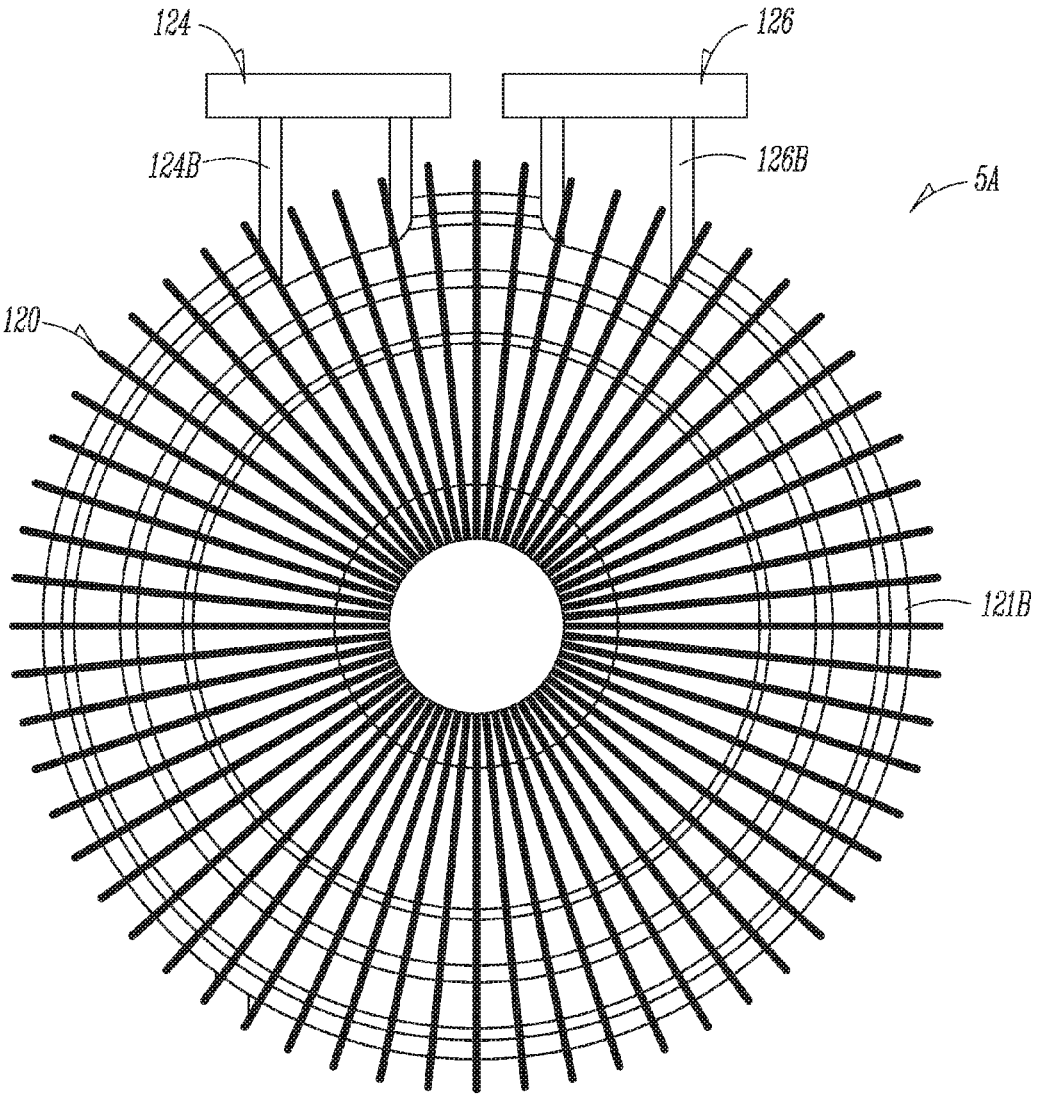
Figure 4D:
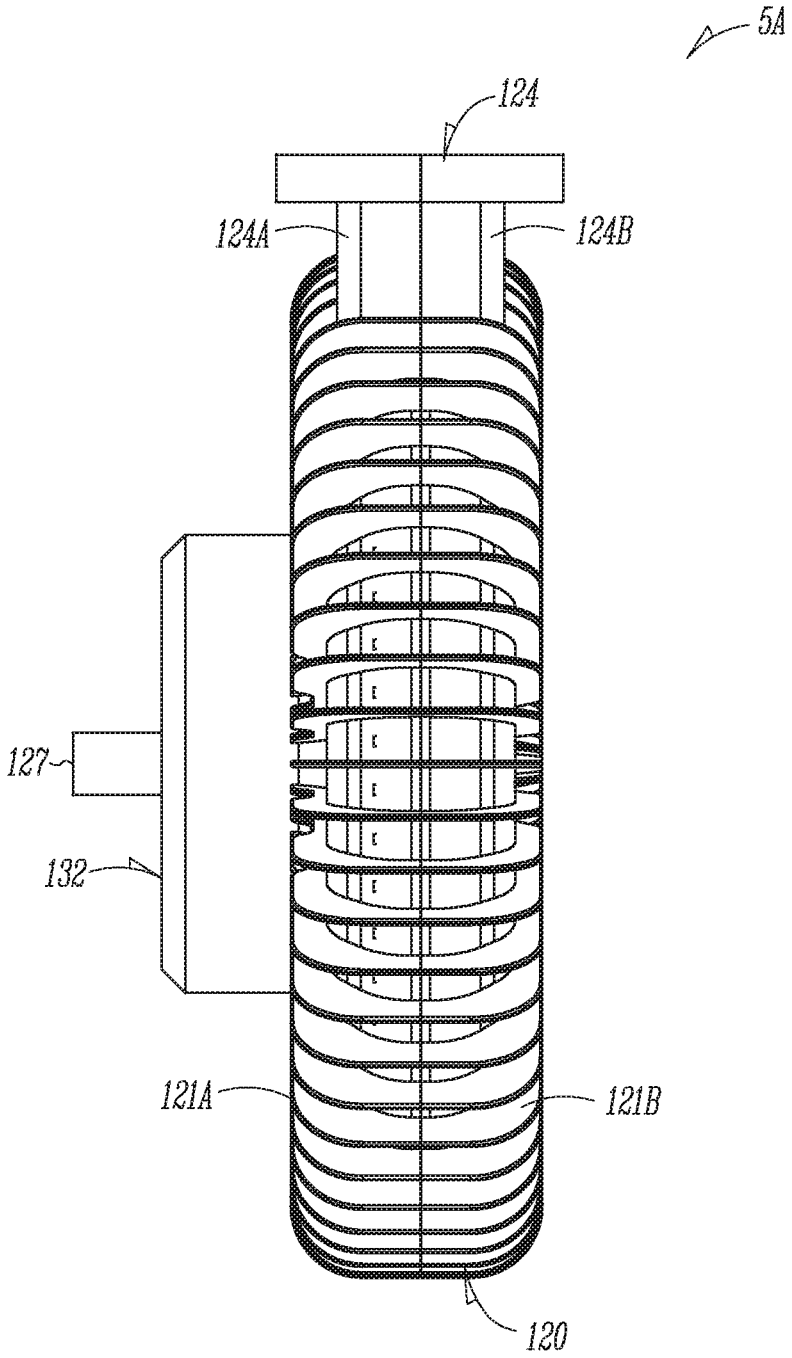
Figure 4E:
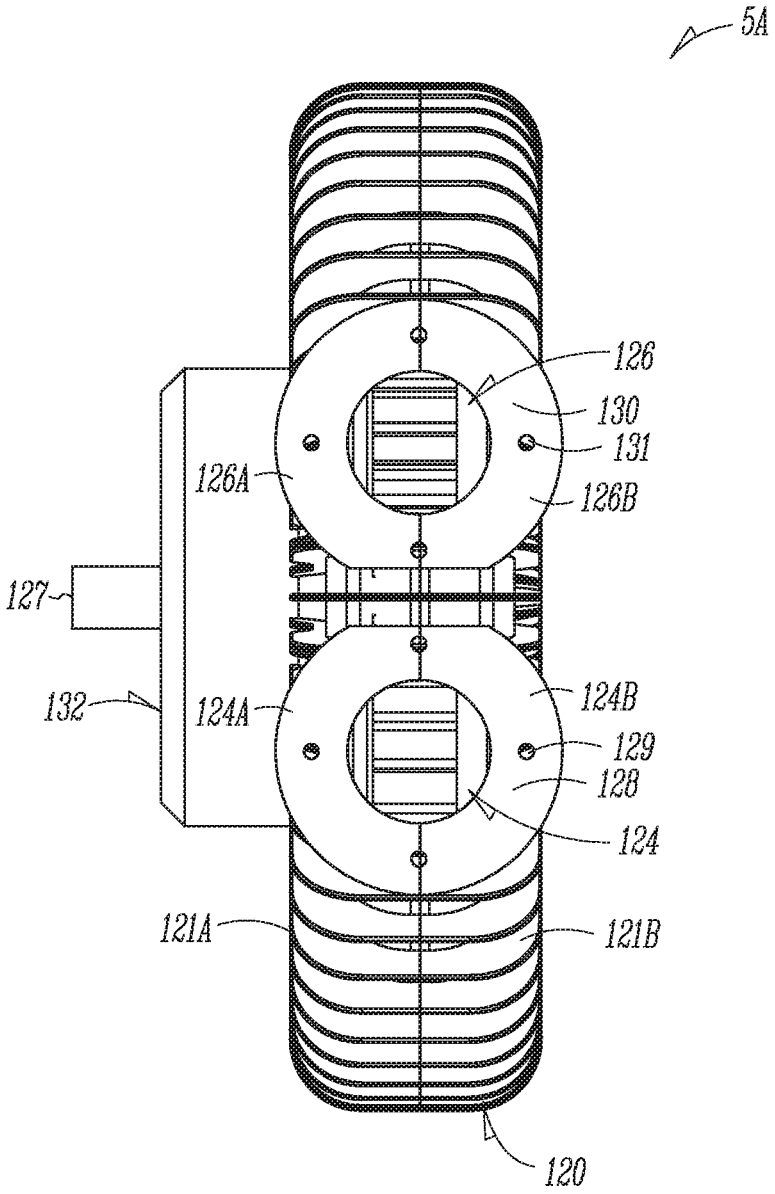

FIG. 3 is an exploded perspective view of the drive system 3 in accordance with at least one example of the present disclosure. As illustrated in FIG. 3, the interface assembly 6 can include an adapter plate 24 secured to the power plant 4 adjacent to a power output shaft 25 of the power plant 4 and a coupler assembly or coupling means 26 for coupling a power input shaft 27 of the regenerative blower 5 in rigid, rotationally fixed contact to the power output shaft 25 of the power plant 4. The coupling means 26 can include a flywheel assembly 28 having a power input surface 29 rotationally secured in rigid contact to the power output shaft 25 of the power plant 4 external to the adapter plate 24, a power output surface 30, and a rigid coupling 32 having a power input surface 34 rotationally secured between the output surface 30 of the flywheel assembly 28 and the power input shaft 27 of the regenerative blower 5 for transmitting rotational power thereto in the form of torque from the flywheel assembly 28. The interface assembly 6 can further include a rigid structural connector 38 secured between the adapter plate 24 of the power plant 4 and a face 40 of the regenerative blower 5 adjacent to the power input shaft 27, the connector 38 being structured to rigidly coaxially align the power input shaft 27 of the regenerative blower 5 and the power output shaft 25 of the power plant 4. The connector 38 can be sized to space a distal or end face 41 of the power input shaft 27 in close proximity to the output surface 30 of the flywheel assembly 28.

As illustrated in FIG. 3, the flywheel assembly 28 can include, for example, the adapter plate 24 that is bolted or otherwise secured to a face 42 of the power plant 4 whereat the power output shaft 25 outputs as torque power generated by the power plant 4. A flywheel 44 can be mounted on the power output shaft 25 for transmitting power output by the power output shaft 25. The flywheel assembly 28 can also include a rigid annular disk or plate 45 having a power input surface 46 configured to be secured to a power output face 48 of the flywheel 44. The annular plate 45 can be structured of suitable material, diameter and thickness to transmit torque generated by the power plant 4. The flywheel assembly 28, as illustrated in FIG. 3, can also include a coupling hub 50 that can be secured to the annular plate 45. The coupling hub 50 can include the output surface 30 and can be structured of suitable material, diameter and thickness for transmitting torque generated by the power plant 4 and transmitted through the flywheel 44 and annular plate 45.

The coupling hub 50 can include a central hub portion 84 that can be structured with the flywheel assembly output surface 30 for forming a substantially inflexible or rigid, rotationally fixed mechanical joint with the power input shaft 27 of the regenerative blower 5 for directly transmitting torque thereto from the power plant 4. For example, the flywheel assembly output surface 30 can be a bore in the central huh portion 84, the bore being formed with an internal spline, a keyway, or other suitable means for forming a rigid and rotationally fixed joint with the power input surface 34 of the coupling 32, and thereafter to the regenerative blower input shaft 27.

The coupling 32 can include, for example, a hub 86 formed with the power input surface 34 and a power output surface 88. The power input surface 34 can be structured to cooperate with the power output surface 30 portion of the coupling hub 50 to form a rigid, rotationally fixed joint. For example, when the power output surface 30 is a bore that includes an internal spline, the power input surface 34 of the cooperating hub 86 can include an external spline structured to mate with the internal spline 30.

The power output surface 88 can be structured to cooperate with the power input drive shaft 27 to form a rigid, rotationally fixed joint therewith. The hub 86 can thereby form a rigid, rotationally fixed joint between the regenerative blower 5 and the power plant 4 for directly transmitting torque thereto. For example, the power output surface 88 can include an internal bore sized to accept the power input shaft 27 of the regenerative blower 5.

The coupling 32 can also include means for rotationally fixing the hub 86 relative to the regenerative blower power input shaft 27. For example, a key 90 can be inserted in respective cooperating keyways 92, 94 in the input drive shaft 27 of the regenerative blower 5 and the internal bore 88 of the hub 86. The key 90 can therefore rotationally fix the hub 86 relative to the blower shaft 27 for transmitting torque through the interface assembly 6 to the regenerative blower 5.

In an example, the structural connector 38 can be configured as a rigid metal housing that can be bolted or otherwise secured to the face 40 of the regenerative blower 5 adjacent to where the power input shaft 27 projects. An opposing side of the structural connector can be bolted or otherwise secured to the adapter plate 24 of the power plant The structural connector 38 can be configured to precisely and coaxially align the power input shaft 27 of the regenerative blower with the power output shaft 25 of the power plant 4.

After being rigidly joined and rotationally secured to the power input shaft 27 of the regenerative blower 5 as described herein, the splined hub 86 can be inserted into the internally splined central hub portion 84 of the coupling hub 50. The intermeshed output and input splines 30, 34 can thereby conjoin the power input shaft 27 in rigid, rotationally fixed contact with the power output shaft 25. Torque generated by the power plant 4 can thus be transmitted to the regenerative blower 5 without relative rotational motion between the power output and input shafts 25, 27.

FIGS. 4A-E are perspective, front, rear, side, and top views, respectively, of a regenerative blower 5A, which represents one example of the regenerative blower 5 in accordance with the present disclosure. In general, regenerative blowers can be configured for moving large volumes of air at low pressure, thereby creating a vacuum source. Unlike positive displacement pumps, regenerative blowers can be configured for regenerating air molecules through a non-positive displacement process to create to the vacuum source. Particularly, regenerative blowers are dynamic compression devices that utilize a non-contacting impeller to accelerate the air molecules within a blower housing to compress the air. In various examples, cooling can be accomplished by blowing air over the blower housing or using cooling fins formed on the blower housing. Suction and discharge ports of the regenerative blower can include a silencer for reducing the noise output of the blower and a filter, such as a mesh screen, for preventing the passage of debris.

As illustrated in FIGS. 4A-E, the regenerative blower 5A can include a blower housing 120 having first housing portion 121A and a second housing portion 12B, a suction port 124 configured to be coupled to the vacuum piping 18 (FIG. 2) for generating high vacuum in the recovery tank 11, and a discharge port 126 configured for exhausting air from within an interior of the blower housing 120. An upper flange portion 128 of the suction port 124 can include one or more mounting features, such as mounting apertures 129, configured to allow coupling of the suction port 124 to the recovery tank 11 or associated piping. An upper flange portion 130 of the discharge port 126 can include one or more mounting features, such as mounting apertures 131, configured to allow coupling of the discharge port 126 to exhaust piping. The suction port 124 can include a first suction port portion 124A extending from the first housing portion 121A and a second suction port portion 124B extending from the second housing portion 121B. Similarly, the discharge port 126 can include a first discharge port portion 126A extending from the first housing portion 121A and a second discharge port portion 126B extending from the second housing portion 121B. In an example, the discharge port 126 can be fluidly coupled to another component of the cleaning system 1, such as the heat exchanger system 10, for providing heated air thereto. The heated air from the discharge port 126 can, in various examples, be utilized at least in part for heating the pressurized fresh water that will be mixed with cleaning solution and delivered to the wand 14.

In an example, the blower housing 120 can be coupled to a bracket or mounting plate (not shown) that is configured to be secured to the support frame 2 (FIGS. 1 and 2). The blower housing 120 can be formed from any suitable material, such as a metallic material. In an example, the blower housing 120 can be formed from die-cast aluminum. Optionally, the blower housing 120 can be coated or plated with a suitable material, such as a nickel coating. The coating or plating can prevent, among other things, oxidization or corrosion of the blower housing 120 when contacted by water and chemical solutions.

As further illustrated in FIGS. 4A-E, a power input shaft 127 of the regenerative blower 5A can extend through an opening in a front face 132 of the blower housing 120. The power input shaft 127 can be driven by a suitable power plant, such as the power plant 4 of the slide-in cleaning system 1 illustrated in FIGS. 1 and 2. In an example, the front face 132 of the regenerative blower 5A can include one or more mounting features, such as mounting apertures 135, configured to allow coupling of the regenerative blower 5A to an interface assembly, such as the interface assembly 6. However, as discussed above, the regenerative blower 5A can be driven by alternative power plants, such as via a drive shaft (or power output shaft) extending from a vehicle engine in a vehicle-powered system, or from an electric motor. As further discussed above, any suitable interface assembly, including but not limited to those referenced herein, can be used to transmit rotation and torque from the power plant to the power input shaft 127.

In operation, air can be drawn from the recovery tank 11 (FIG. 2) into the regenerative blower 5A through the suction port 124. The air molecules in the air flow drawn into the regenerative blower 5A can be repeatedly struck by an impeller thereby accelerating and compressing the air molecules. In an example, the air molecules substantially complete one revolution within the blower housing 120 before they are exhausted through the discharge port 126. Because the recovery tank 11 is substantially sealed from the atmosphere, suctioning air from the recovery tank 11 through the regenerative blower 5A causes a low pressure to be generated within the tank. This low pressure can allow for vacuum extraction of gray water through the vacuum hose extending between the wand 14 and the recovery tank 11.

Figure 5A:
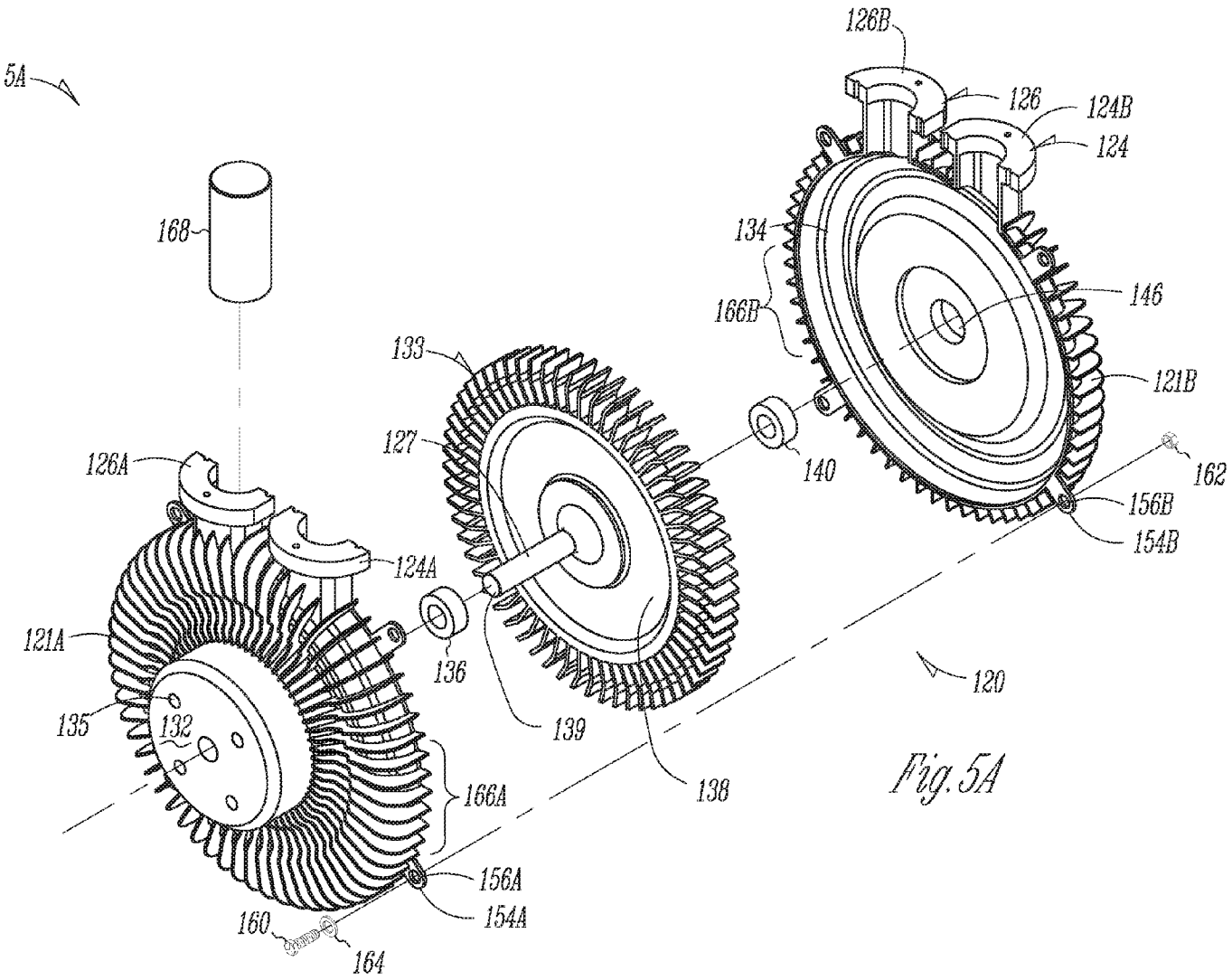
FIGS. 5A and 5B are exploded perspective and side views, respectively, of the regenerative blower of FIGS. 4A-E, in accordance with at least one example of the present disclosure.
Figure 5B:
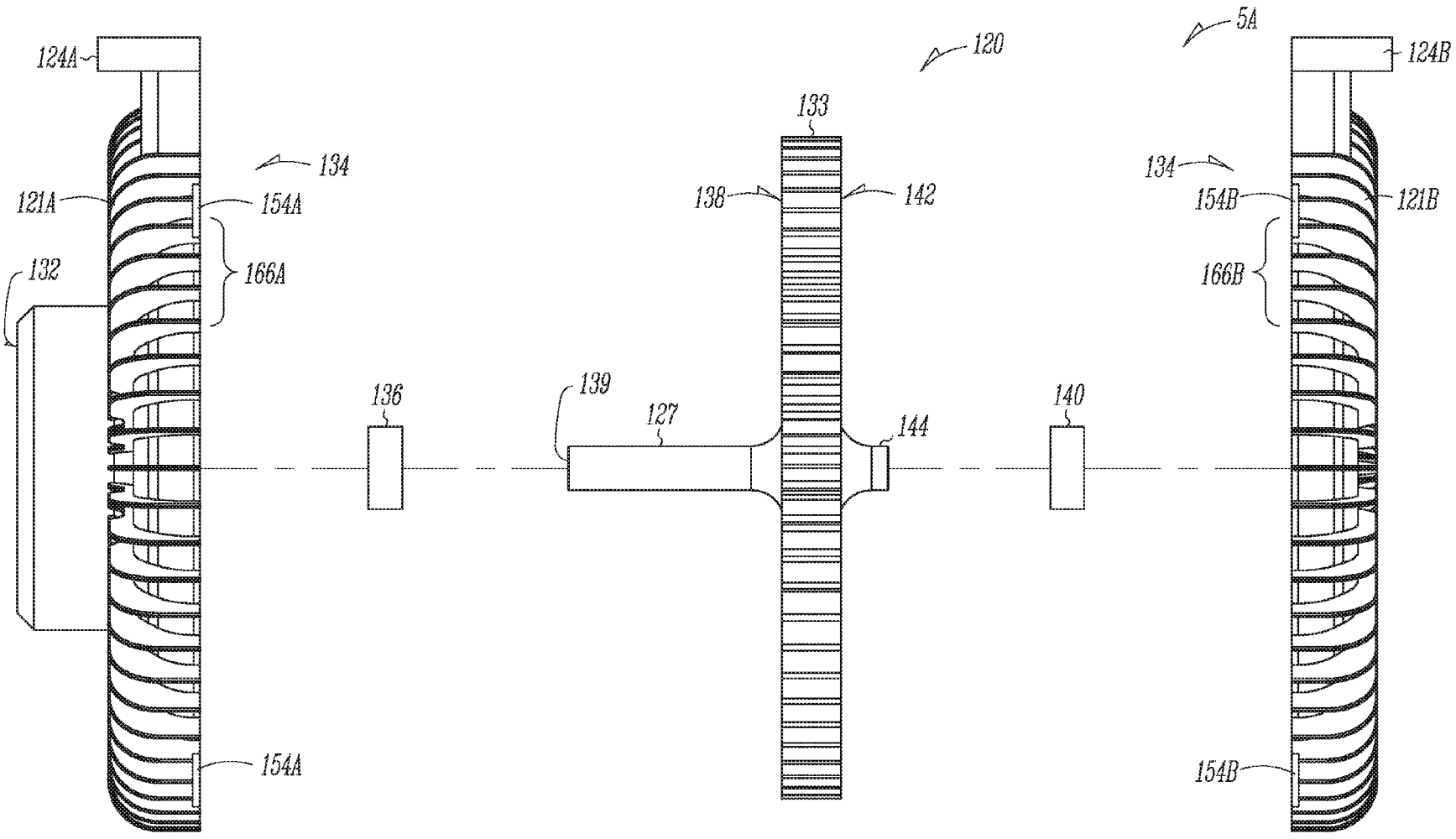

FIGS. 5A and 5B are exploded perspective and side views, respectively, of the regenerative blower 5A in accordance with at least one example of the present disclosure. As illustrated in FIGS. 5A and 5B, the regenerative blower 5A can include an impeller 133 configured to be positioned within an interior chamber 134 of the blower housing 120. In an example, as shown in FIGS. 5A and 5B, the impeller 133 can be formed integral with the power input shaft 127, or the power input shaft 127 can be permanently fixed to the impeller by a suitable connection means such as welding. In other examples, the power input shaft 127 can be a separate component from the impeller 133, and the two components can be coupled together during assembly, such as by a keyway fitting.

As further illustrated in FIGS. 5A and 5B, a first bearing 136 can be positioned between a first side 138 of the impeller 133 and the first housing portion 121A. In an example, the first bearing 136 can be configured to receive a first end 139 of the power input shaft 127. The first bearing 136 can be secured to an inner surface of the first housing portion 121A using any suitable connection means, such as by a press-fit connection or one or more fastening members configured to engage the first bearing 136 and the first housing portion 121A. Similarly, a second bearing 140 can be positioned between a second side 142 of the impeller 133 and the second housing portion 121B. In an example, the second bearing 140 can be configured to receive a second end 144 of the power input shaft 127. The second bearing 140 can be secured to an inner surface of the second housing portion 121B using any suitable connection means, such as by a press-fit connection into a channel 146 formed in the inner surface of the second housing portion 121B, or one or more fastening members configured to engage the second bearing 140 and the second housing portion 121B.

The first housing portion 121A can be coupled to the second housing portion 121B using any suitable connection means. In an example, as illustrated in FIG. 5A, the first housing portion 121A can include one or more flanges 154A each including an aperture 156A. Similarly, the second housing portion 121B can include one or more flanges 154B each including an aperture 156B. In order to couple the first housing portion 121A to the second housing portion 121B, the one or more flanges 154A of the first housing portion 121A can be aligned with the one or more flanges 154B of the second housing portion 121B. Subsequently, a fastening member 160 can be inserted through the apertures 156A, 1156B of the aligned flanges 154A, 154B. In an example, the fastening member 160 can be threaded, such as a bolt or a screw, and can be configured to mate with a mounting nut 162 on an opposing side of the flange 154B. A washer 164 can also be positioned between the flange 154A and the fastening member 160.

As further illustrated in FIGS. 5A and 5B, the first housing portion 121A can include a series of fins 166A extending from an outer surface. Similarly, the second housing portion 121B can include a series of fins 166B extending from an outer surface. In an example, the fins 166A and 166B can assist with the dissipation of heat from within the blower housing 120 during operation of the regenerative blower 5A.

In an example, as illustrated in FIG. 5A, the discharge port 126 can be configured to receive a muffler or silencer member 168 therein. The silencer member 168 can be configured to, for example, muffle the output noise level generated from the exhaust directed through the discharge port 126. In an example, the silence member 168 can be configured to reduce the noise output level to about 70 decibels or less.

Figure 6:
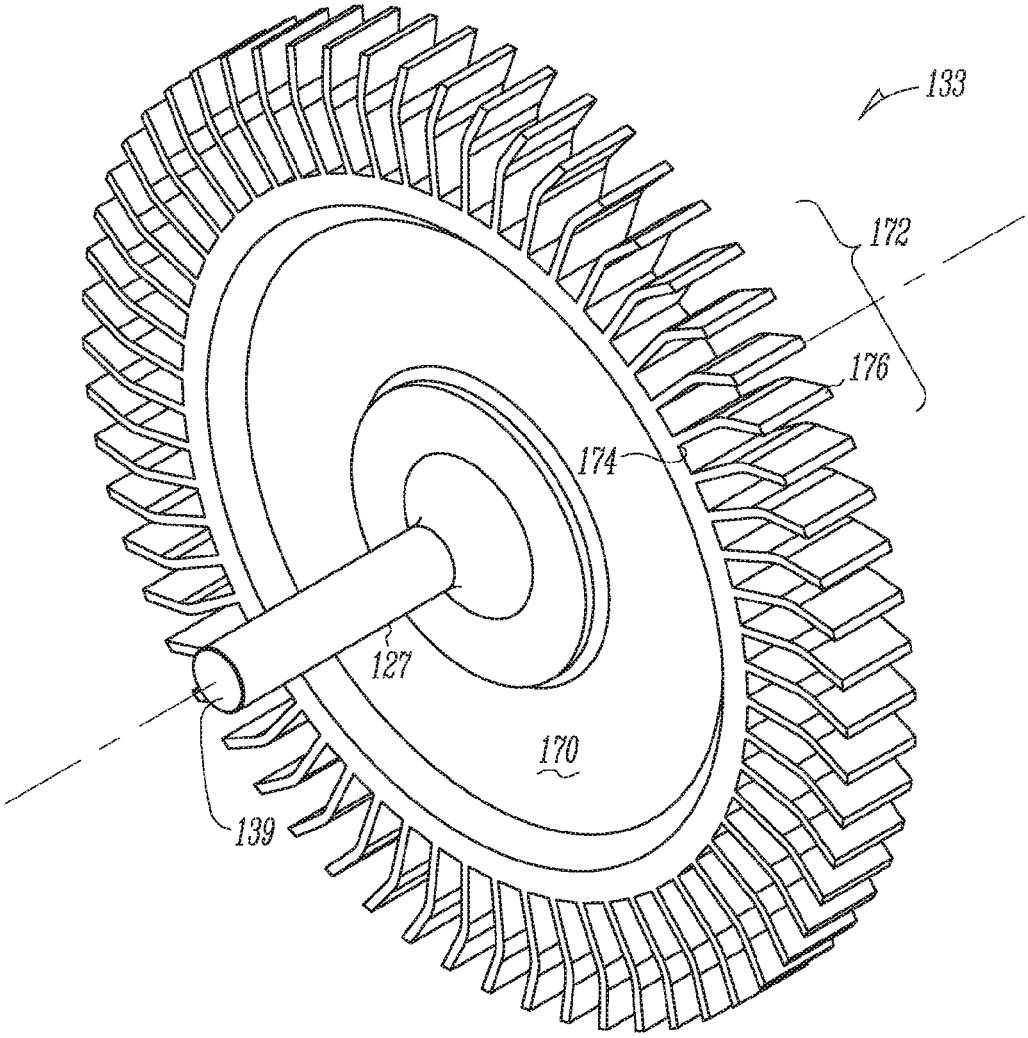
FIG. 6 is a perspective view of an impeller for a regenerative blower, in accordance with at least one example of the present disclosure.

FIG. 6 is a perspective view of the impeller 133 in accordance with at least one example of the present disclosure. As illustrated in FIG. 6, the impeller 133 can include a central hub 170 and a plurality of blades 172 extending around a circumference of the central hub 170. In an example, at least a portion of each of the blades 172 can be bent or curved between a first end 174 adjacent to the central hub 170 and an opposite second end 176 spaced from the central hub 170. In an example, the curvature of the blades 172 can assist with circulation of the air molecules within the blower housing 120. The blades 172 are illustrated as having an identical curvature merely for purposes of example and not limitation. In other examples, one or more of the blades 172 can have a curvature that is different from the other blades 172.

As discussed above, in an example, the impeller 133 can be formed integral with the power input shaft 127, such as by a casting process. However, the power input shaft 127 can be formed separate from the impeller 133, and the two components can be coupled together using any suitable coupling means. Furthermore, the blades 172 can be formed separate from the central hub 170 and attached thereto during manufacturing, such as by welding.

Figure 7:
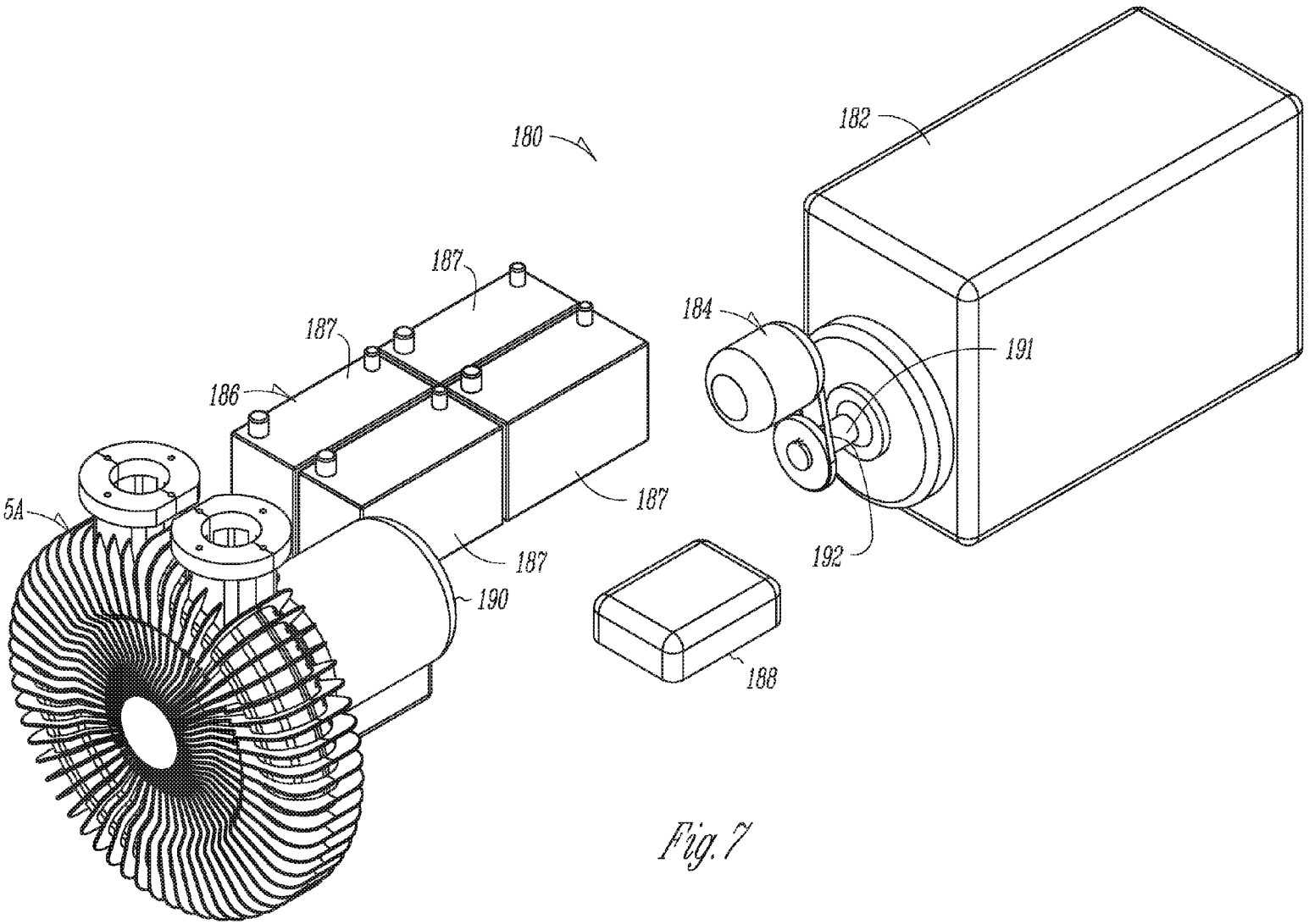
FIG. 7 is a perspective view of a regenerative blower configured to be powered by an electric drive assembly, in accordance with at least one example of the present disclosure.

FIG. 7 is a perspective view of the regenerative blower 5A configured to be powered by an electric drive assembly 180. As illustrated in FIG. 7, the electric drive assembly 180 can include an engine 182, such as an internal combustion engine, an alternator 184, a battery pack 186 having one or more batteries 187, a motor controller 188, and an electric motor 190. In an example, the engine 182 can convert a liquid or gaseous fuel source into rotary motion of a power output shaft 191. The engine 182 can be the engine of a host vehicle in which the cleaning system is mounted, or a dedicated engine for the cleaning system. The alternator 184, which can include one or more belts 192, can covert the rotary motion of the engine 182 into electricity. The alternator 184 can include a regulation circuit to regulate the alternator output. The battery pack 186 can store the energy from the alternator 184 as chemical potential. Thus, the battery pack 186 can be configured to emit electric energy that can be used to drive the electric motor 190.

The electric motor 190 can convert the electric current from the battery pack 186 into rotary motion, which can be transmitted to the power input shaft 127 (not shown) of the regenerative blower 5A. In an example, the electric motor 190 can also be used to power other components, such as pumps, compressors, heating elements, or the like.

The motor controller 188 can be configured to condition and regulate the electric voltage and current into the components to which it supplies power, such as the electric motor 190. The motor controller 188 can also provide means to indirectly regulate the operational speed of the electric motor 190.

Although not shown, the electric drive assembly 180 can include various interconnecting and control devices. These interconnecting and control devices can include, for example, wires, switches, bulbs, overcurrent protection (such as fuses/breakers), and thermal protection.

The regenerative blower 5A is described and illustrated herein as a "single-stage" blower, wherein air molecules travel around the blower housing 120 a single time prior to being exhausted, merely for purposes of example. In various alternative examples, the regenerative blower 5A can be a "multi-stage" blower, such as a "two-stage" blower that can be configured to provide about twice the vacuum of a single-stage unit. Two-stage regenerative blowers can be configured to operate similar to a single-stage blower wherein an impeller can repeatedly strike the air molecules to create pressure and, consequently, the vacuum. However, in a two-stage blower, air molecules can make a first revolution around a front side impeller and, rather than being exhausted after the first revolution like the regenerative blower 5A, the air flow can be directed back to a rear side impeller through one or more channels provided in the blower housing. The redirected air molecules can then make a second revolution around the rear side impeller thereby doubling the number of times that impellers strike the air molecules. Once the air molecules have completed the second revolution around the rear side impeller, the air flow can be exhausted. Thus, two-stage blowers can be operable to provide higher pressures and vacuums because the impellers strike the air molecules over a period of two revolutions instead of just one as in a single-stage regenerative blower.

One benefit of the exemplary regenerative blower 5A in accordance with the present disclosure, compared to other blowers such as positive displacement pumps, can be that the blower requires minimal monitoring and maintenance. As discussed above, the impeller 133 is the only moving part in the regenerative blower 5A. Because the impeller 133 does not contact the blower housing 120 during rotation, the impeller 133 can be substantially wear-free. The first and second bearings 136 and 140, which can generally be self-lubricated, can be the only components that experience any significant wear over a long period of operation. Another benefit of the exemplary regenerative blower 5A can reside in the fact that the blower does not utilize oil, and also do not require a complicated intake and exhaust valve system. Because regenerative blowers are non-positive displacement devices, another benefit of the exemplary regenerative blower 5A can be the generation of discharge air that is generally "clean" and substantially pulsation-free.

Although the regenerative blower 5A is illustrated as being mounted with the impeller 133 in a plane generally perpendicular to the support frame 2, the regenerative blower 5A can alternatively be mounted in any plane. Regardless of the plane in which the regenerative blower 5A is mounted, the impeller 133 can be dynamically balanced such that minimal vibration is generated by the blower during operation. Additionally, although the regenerative blower 5A is described herein as including a single suction port 124 and a single discharge port 126, in various examples, multiple suction and discharge connection configurations can be utilized.

The above Detailed Description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 CFR. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A cleaning system, comprising:

a power plant;

a regenerative blower having a power input shaft, a suction port, a discharge port, and an impeller coupled to the power input shaft;

an interface assembly configured for transmitting power from the power plant to the regenerative blower; and a pump configured for generating pressurized water.

2. The cleaning system of claim 1, further comprising a support frame, wherein at least one of the power plant, the regenerative blower, and the pump is coupled to the support frame.

3. The cleaning system of claim 1, further comprising one or more wands having an input configured to receive the pressurized water for distribution to a surface to be cleaned.

4. The cleaning system of claim 3, further comprising one or more delivery hoses extending between the pump and the one or more wands and configured to deliver the pressurized water to the one or more wands.

5. The cleaning system of claim 4, further comprising a vacuum recovery tank, the vacuum recovery tank having a first input coupled to the suction port of the regenerative blower and one or more second inputs coupled to one or more vacuum hoses extending between the recovery tank and the one or more wands.

6. The cleaning system of claim 5, further comprising a chemical distribution system configured to deliver a stream of cleaning chemical into the pressurized water for delivery by the one or more wands.

7. The cleaning system of claim 1, wherein the impeller is removably coupled to the power input shaft.

8. The cleaning system of claim 1, wherein the impeller is formed integral with the power input shaft.

9. The cleaning system of claim 1, wherein the power plant is a combustion engine.

10. The cleaning system of claim 1, wherein the power plant is an electric motor.

11. A cleaning system, comprising:

a power plant having a power output shaft;

a regenerative blower including a blower housing having a suction port and a discharge port and defining a blower chamber, the regenerative blower further including an impeller disposed within the blower chamber and a power input shaft extending from the impeller, wherein the impeller includes a central hub and a plurality of blades extending around a circumference of the central hub, wherein each of the blades is curved between a first end adjacent to the central hub and a second end spaced from the central hub;

an interface assembly configured for transmitting power from the power output shaft of the power plant to the power input shaft of the regenerative blower;

a pump configured for generating pressurized water; and one or more wands having an input configured to receive the pressurized water for distribution to a surface to be cleaned.

12. The cleaning system of claim 11, further comprising a vacuum recovery tank, the vacuum recovery tank having a first input coupled to the suction port of the regenerative blower and one or more second inputs coupled to one or more vacuum hoses extending between the recovery tank and the one or more wands.

13. The cleaning system of claim 12, wherein the blower housing includes a first housing portion and a second housing portion configured to be secured together to substantially enclose the impeller.

14. The cleaning system of claim 13, further comprising a bearing assembly positioned between an inner surface of one of the first housing portion and the second housing portion and a central hub of the impeller, the bearing assembly configured to allow rotation of the impeller relative to the blower housing.

15. The cleaning system of claim 11, wherein the discharge port includes a silencer configured to reduce a noise output level of the regenerative blower.

16. The cleaning system of claim 11, wherein the power plant is a combustion engine.

17. The cleaning system of claim 11, wherein the power plant is an electric motor.

18. A vacuum extraction cleaning system, comprising:

a power plant;

a regenerative blower including:

a blower housing having a suction port and a discharge port and defining a blower chamber;

one or more impellers disposed within the blower chamber;

a power input shaft extending from the one or more impellers; and one or more bearings configured to allow rotation of the one or more impellers within the blower chamber;

an interface configured to allow coupling of the power plant to the power input shaft of the regenerative blower;

a pump configured for generating pressurized water;

one or more wands configured to receive the pressurized water for distribution to a surface to be cleaned; and a vacuum recovery tank, the vacuum recovery tank having a first input coupled to the suction port of the regenerative blower and one or more second inputs coupled to one or more vacuum hoses extending between the recovery tank and the one or more wands.

* * * * *